US005501240A

United States Patent [19]

Dohku et al.

[11] Patent Number: 5,501,240

[45] Date of Patent: Mar. 26, 1996

[54] CLEANING METHOD AND CLEANING APPARATUS

[75] Inventors: Takeshi Dohku, Osaka; Kazuo Yoshida, Higashi-Osaka; Kazunori Koba, Kawachinagano; Kazuyuki Miyake, Ibaraki, all of Japan

[73] Assignee: Hitachi Zosen Corporation, Osaka, Japan

[21] Appl. No.: 316,441

[22] Filed: Oct. 3, 1994

[30] Foreign Application Priority Data

| | | | |
|---|---|---|---|
| Oct. 6, 1993 | [JP] | Japan | 5-250537 |
| Feb. 25, 1994 | [JP] | Japan | 6-028099 |

[51] Int. Cl.[6] ..... B08B 3/10

[52] U.S. Cl. ..... 134/61; 134/88; 134/102.2; 134/184

[58] Field of Search ..... 134/64 R, 76, 134/102.1, 184, 61, 66, 78, 84, 88

[56] References Cited

U.S. PATENT DOCUMENTS

| | | | |
|---|---|---|---|
| 1,036,988 | 8/1912 | Fink | 134/102.2 |
| 3,527,607 | 9/1970 | Antonevich | 134/184 X |
| 4,333,485 | 6/1982 | Karlsson et al. | 134/184 X |
| 4,881,561 | 11/1989 | Schwarzwaldeiz | 134/184 X |
| 4,895,176 | 1/1990 | Ohtsuka et al. | 134/184 X |
| 4,909,266 | 3/1990 | Massa | 134/184 X |
| 4,967,777 | 11/1990 | Takayama et al. | 134/102.2 |
| 5,067,983 | 11/1991 | Uchino | 134/184 |
| 5,333,629 | 8/1994 | Higashino | 134/76 |
| 5,345,958 | 9/1994 | Otsuka | 134/184 |

FOREIGN PATENT DOCUMENTS

| | | | |
|---|---|---|---|
| 0523678 | 7/1992 | European Pat. Off. . | |
| 1303049 | 7/1962 | France | 134/102.2 |
| 3022609 | 6/1980 | Germany . | |
| 3901986 | 1/1989 | Germany . | |
| 4136816 | 11/1991 | Germany . | |
| 735332 | 5/1980 | U.S.S.R. | 134/184 |

*Primary Examiner*—Frankie L. Stinson
*Attorney, Agent, or Firm*—Armstrong, Westerman, Hattori, McLeland & Naughton

[57] ABSTRACT

The invention provides a cleaning method comprising:

a step of immersing the object of cleaning first in a first tank to wash roughly by bubbling from beneath, and showering with purified water from above when lifting the object, a step of immersing the object coming from the first tank in a second tank to wash preliminarily with ultrasonic waves, and showering with purified water from above when lifting the object, a step of immersing the object coming from the first tank or second tank successively in a third tank to wash thoroughly with ultrasonic waves and water jet, and showering with purified water from above when lifting the object, and a step of immersing the object coming from the third tank finally into a fourth tank to finish with water jet, and lifting. In this cleaning method, only purified water harmless to human and environment is used as cleaning fluid, and the same cleanliness as in conventional cleaning with chlorofluorocarbons or trichloroethane is obtained, while there is no side effect such as discoloring of work surface.

2 Claims, 6 Drawing Sheets

CLEANING METHOD AND CLEANING APPARATUS

BACKGROUND OF THE INVENTION

The present invention relates to a method of cleaning metal products and components, for example, aluminum precision parts such as head and photosensitive drum of video tape recorder (VTR), mainly for the purpose of degreasing, and a cleaning apparatus used in such method.

Hitherto, aluminum precision parts such as VTR head and photosensitive drum were cleaned by immersion ultrasonic cleaning or vapor cleaning by using chlorofluorocarbons or trichloroethane as cleaning fluid. However, chlorofluorocarbons and trichloroethane are ozone layer destroying substances, and their use is regulated, and they are being replaced by organic solvents such as methylene chloride and methanol (see the Japanese Laid-open Patent No. 3-144459). Besides, a degreasing cleaning apparatus using a water-based detergent such as alkali or surface active agent has been also developed.

Chlorofluorocarbons and trichloroethane are thus restricted, and methylene chloride and other organic solvents are harmful for human health and also involve problems in safety of work such as explosiveness.

Water-based detergents have side effects such as discoloration of the work surface, and it is extremely difficult to remove detergents by rinsing. The water-based detergent can easily remove oil chemically (wettable in water) and clean, but it means difficulty in separation into oil and water after cleaning. Therefore, in cleaning by using such water-based detergent, waste water treatment is huge in scale, requiring a wide area of installation and a high facility cost.

In the light of the above background, it is hence a primary object of the invention to present a cleaning method free from side effects such as discoloration of work surface, by using only purified water which is harmless to human health and environments as cleaning fluid, while obtaining the same cleanliness as in the conventional cleaning with chlorofluorocarbons or trichloroethane, and a cleaning apparatus used in such method.

SUMMARY OF THE INVENTION

To achieve the object, the invention presents a cleaning method comprising:

- a step of immersing the object of cleaning first in purified water in a first tank to wash roughly by bubbling from beneath, and showering with purified water from above when lifting the object,
- a step of immersing, if necessary, the object coming from the first tank in purified water in a second tank to wash preliminarily with ultrasonic waves, and showering with purified water from above when lifting the object,
- a step of immersing the object coming from the first tank or second tank successively in purified water in a third tank to wash thoroughly with ultrasonic waves and water jet, and showering with purified water from above when lifting the object, and
- a step of immersing the object coming from the third tank finally in purified water in a fourth tank to finish with water jet, and lifting the object.

In this cleaning method, ultrasonic wave treatment for washing preliminarily and washing thoroughly is preferably done continuously while washing. Besides, water jet treatment for washing thoroughly and finishing is preferably done intermittently.

In a preferred mode of the invention, low grade purified water with resistivity of 1.0 MΩ•cm or less is supplied in the third tank as washing water, and is also used as shower water in the first tank, second tank provided if necessary, and third tank, whereas high grade purified water with resistivity of 1.0 to 15 MΩ•cm is supplied in the fourth tank as washing water, and the washing water in the third tank is caused to overflow sequentially therefrom into the second tank provided if necessary, and first tank.

The low grade purified water is, preferably, water obtained by treating original water such as city water and industrial water with by a reverse osmotic film apparatus, and the high grade purified water is, preferably, water obtained by treating low grade purified water with an evaporation method high temperature purified water manufacturing apparatus.

The water temperature in the third tank and fourth tank is preferably 45° to 60° C., and the water temperature in the first tank is preferably 40° C. or more.

In the first tank, bubbling may be replaced by rough washing of the object by water jet.

It is also preferred to blow away deposits from the surface of the object by injecting compressed air to the object prior to immersion in the first tank.

The washing waste water discharged from the first tank and fourth tank may be treated by first and second ultrafiltration waste water treating systems to separate it into oil and water, and the filtered water from the first ultrafiltration waste water treating system may be sent into the reverse osmotic film apparatus and the filtered water from the second ultrafiltration waste water treating system may be sent into the evaporation method high temperature purified water manufacturing apparatus to be recycled as original water, respectively.

The invention presents a first cleaning apparatus comprising:

- a first tank having a bubbling device disposed in the bottom, and a spray nozzle located above,
- a second tank, provided if necessary, having an ultrasonic wave generating device disposed in the bottom or on the side, and a spray nozzle located above,
- a third tank having an ultrasonic wave generating device disposed in the bottom or on the side, a water jet generating device in the bottom, and a spray nozzle located above, and
- a fourth tank having a water jet generating device disposed in the bottom.

The first cleaning apparatus may also comprise a reverse osmotic film apparatus for producing low grade purified water used as washing water supplied in the first tank, second tank provided if necessary, and third tank, and also as shower water in the first tank, second tank provided if necessary, and third tank, and an evaporation method high temperature purified water manufacturing apparatus for producing high grade purified water to be supplied in the fourth tank.

The invention presents a second cleaning apparatus which is a degreasing cleaning apparatus comprising a first tank, a second tank, a third tank, and a fourth tank, with the purified water supplied in the fourth tank flowing into the first tank by way of the third tank and second tank, wherein a bubbling device is installed in the bottom of the first tank, ultrasonic wave generating devices are disposed in the bottom or on the side of the second and third tanks, together with water jet generating devices disposed in each bottom, a water jet generating device is disposed in the bottom of the fourth tank, and a partition tube for guide of water flow is disposed vertically at least in one of the four tanks.

In a modified example of the second cleaning apparatus, the second tank and third tank of the second cleaning apparatus are omitted. That is, this is a degreasing cleaning apparatus having a first tank and a fourth tank, with the purified water supplied in the fourth tank flowing into the first tank, wherein a bubbling device is disposed in the bottom of the first tank, and a water jet generating device is disposed in the bottom of the fourth tank, and a partition tube for guide of water flow is disposed vertically at least in one of the first tank and fourth tank.

In other modified example of the second cleaning apparatus, the first tank and fourth tank of the second cleaning apparatus are omitted. That is, this is a degreasing cleaning apparatus having a second tank and a third tank, with the purified water supplied in the third tank flowing into the second tank, wherein ultrasonic wave generating devices are disposed in the bottom or on the side of these tanks and water jet generating devices in the bottom thereof, and a partition tube for guide of water flow is disposed vertically at least in one of the second tank and third tank.

In a different modified example of the second cleaning apparatus, the first tank and second tank of the second cleaning apparatus are omitted. That is, this is a degreasing cleaning apparatus having a third tank and a fourth tank, with the purified water supplied in the fourth tank flowing into the third tank, wherein an ultrasonic wave generating device is disposed in the bottom or on the side of the third tank, together with a water jet generating device disposed in the bottom, and a water jet generating device is disposed in the bottom of the fourth tank, and a partition tube for guide of water flow is disposed vertically at least in one of the third tank and fourth tank.

In other different modified example of the second cleaning apparatus, the first tank comprising the bubbling device is changed to a tank having an ultrasonic wave generating device disposed in the bottom or on the side, and a water jet generating device in the bottom.

In another different modified example of the second cleaning apparatus, the partition tube for guide of water flow of the second cleaning apparatus is omitted.

According to the second washing apparatus, in the first tank, bubbles by the bubbling device violently agitate the washing liquid, and by this violent agitation and the mutual action of vapor phase and liquid phase, oil, grease, and cutting chips depositing on the metal materials can be washed away. In the second tank having both ultrasonic wave generating device and water jet generating device, the metal material is cleaned further by the cavitation caused by ultrasonic waves, and oil and grease removed by this ultrasonic cleaning stay near the metal material, and are diffused into the tank by the water flow of the water jet, and will not deposit again on the metal material. In the third tank having both ultrasonic wave generating device and water jet generating device same as in the second tank, same washing as in the second tank is effected, and oil, grease and cutting chips depositing on the metal material are removed almost completely. By the fourth tank having the water jet, the metal material after washing is finally rinsed. In this invention, meanwhile, by disposing a partition tube for guide of water flow in the vertical direction at least in one of the first to fourth tanks, the flow velocity in the tank is accelerated, and washing or rinsing is promoted.

In the modified examples, according to the degreasing cleaning apparatus omitting specific two tanks out of the first to fourth tanks of the second cleaning apparatus, metal materials relatively small in deposits of oil or the like can be washed and rinsed in a short time. More specifically, when the second and third tanks are omitted, cleaning by the bubbling device is effected in the first tank, and rinsing by water jet is effected in the tank corresponding to the fourth tank. When the first and fourth tanks are omitted, cleaning and diffusion of oil and grease after cleaning are effected by the ultrasonic wave generating device and water jet generating device in the second and third tanks. Furthermore, when the first tank and second tank are omitted, in a first tank corresponding to the third tank, cleaning and diffusion and flow-out of oil and grease after cleaning are effected by the ultrasonic wave generating apparatus and water jet generating apparatus, and in a tank corresponding to the fourth tank, rinsing is effected by the water jet generating apparatus.

According to the invention, for example, in cleaning of aluminum precision parts such as VTR head and photosensitive drum, purified water is used as cleaning fluid, and therefore the cleaning fluid is harmless to human and environment as described below, while same cleanliness as in conventional cleaning with chlorofluorocarbons and trichloroethane can be obtained, and cleaning can be performed effectively without causing side effects such as discoloration of work surface or cavitation erosion at the time of ultrasonic cleaning.

(1) Harmless to human and environment

As cleaning fluid, only purified water of two different water quality grades is used, and only steam is released to the working environment in the cleaning process, and is completely harmless to human. What is contained in the cleaning waste water is only oily and greasy matter depositing on the object, and only oil can be separated and removed easily by ordinary waste water treating method, and water can be discharged.

(2) Same cleanliness as in cleaning with chlorofluorocarbons or trichloroethane

Washing and rinsing are performed in four or three processes, and in the prestage of cleaning process heavy in the oily deposit on the object, the majority of oil is removed by powerful cleaning method such as bubbling and ultrasonic waves, and rinsing is effected in the final tank in purified water of high grade, and as a result the cleanliness can be heightened to a same level of chlorofluorocarbons and trichloroethane.

(3) Prevention of discoloration and erosion of the surface of object

By keeping the temperature of washing water in a range of 40° to 55° C., the cleaning effect can be raised, and discoloration of the surface of the object due to oxidation reaction can be prevented at the same time. Besides, in the third tank in which the surface of the object is mostly rid of the oily matter and is susceptible to the effect of cavitation by ultrasonic waves, by using water jet together with ultrasonic vibration, the impact force of cavitation can be weakened, and occurrence of erosion by cavitation can be prevented.

THE DETAILED DESCRIPTION OF THE INVENTION

Examples of the invention are described below by reference to the accompanying drawings.

Example 1

Figure 1:
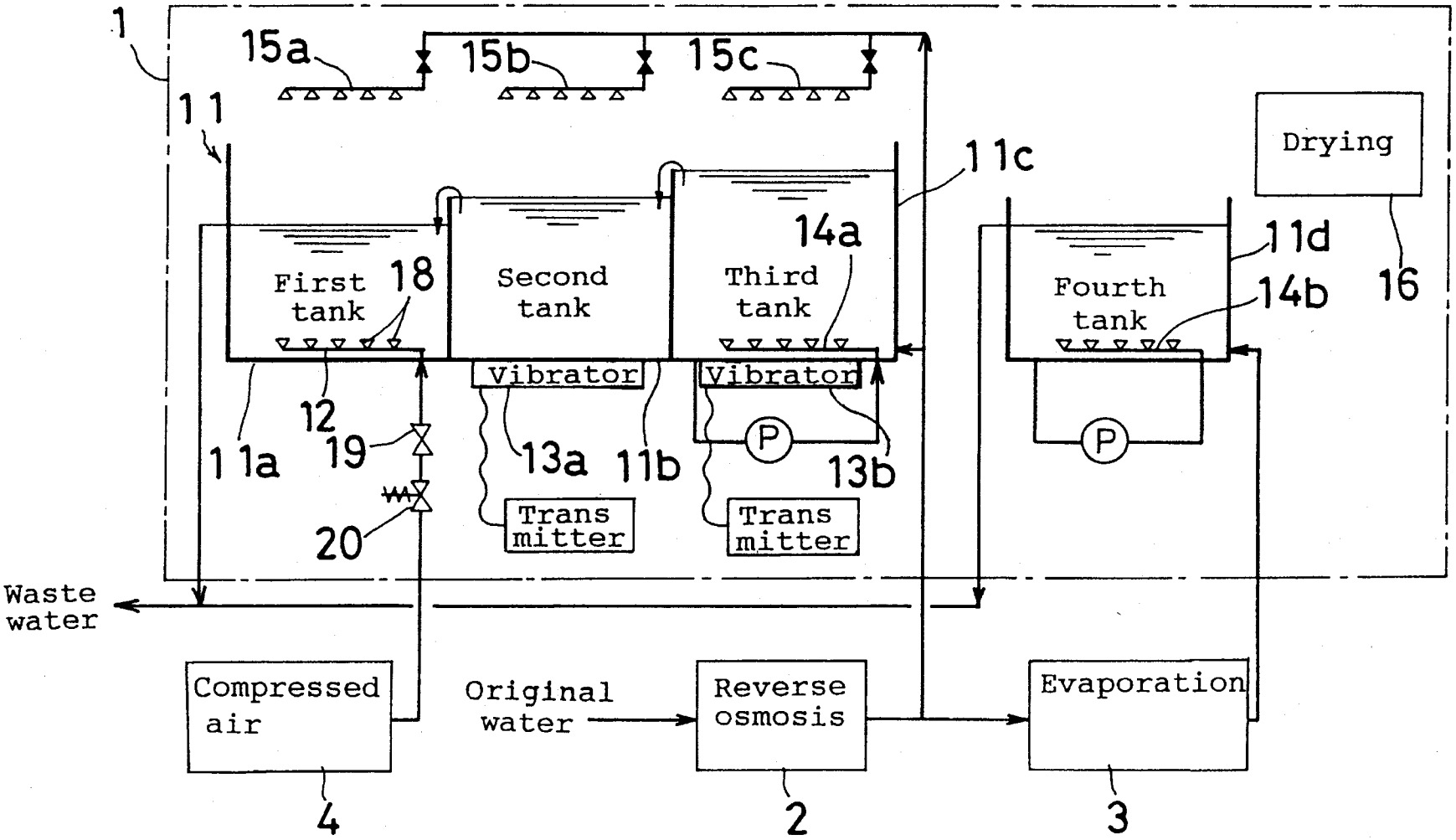
FIG. 1 is a flow sheet showing a cleaning method in embodiment 1.

The cleaning flow shown in FIG. 1 comprises a cleaning apparatus 1, a reverse osmotic film device 2 for feeding purified water into a first tank of the apparatus 1, an evaporation method high temperature purified water manufacturing apparatus 3 for feeding purified water into a fourth tank of the cleaning apparatus 1, and a compressor 4 for feeding compressed air into the first tank of the cleaning apparatus 1.

The cleaning apparatus 1 consists of a cleaning tank 11 composed of a first tank 11*a*, a second tank 11*b*, a third tank 11*c*, and a fourth tank 11*d*, a bubbling device 12 disposed inside the bottom of the first tank 11*a*, ultrasonic wave generating devices 13*a*, 13*b* disposed outside the bottom of the second tank 11*b* and third tank 11*c*, water jet generating devices 14*a*, 14*b* disposed inside the bottom of the third tank 11*c* and fourth tank 11*d*, shower spray devices 15*a*, 15*b*, 15*c* disposed above the first tank 11*a*, second tank 11*b*, and third tank 11*c*, and a dryer 16.

The bubbling device 12 is composed of a compressed air feed tube possessing plural bubble nozzles 18 for injecting bubbles, a compressor 4 for feeding compressed air to the feed tube, a valve 19 provided in the feed tube, and a flow rate (or pressure) regulator 20.

The ultrasonic wave generating devices 13*a*, 13*b* are composed of transmitter and vibrator, and the vibrator is attached to the bottom or side in the cleaning tank.

The water jet generating devices 14*a*, 14*b* are composed of pressure water feed tube having plural jet nozzles for injecting water, and a circulation pump for sucking water in the cleaning tank and feeding to the jet nozzles at a pressure of 3 to 10 kg/cm$^2$.

In this constitution, as the original water, city water or industrial water is treated in the reverse osmotic film device 2, and low grade purified water of resistivity of about 0.1 to 1.0 MΩ•cm at temperature of 50° to 55° C. is produced. This low grade purified water is continuously supplied into the bottom of the third tank 11*c*, and part of it is treated with the evaporation method high temperature purified water manufacturing device 3, and high grade purified water of resistivity of about 10 to 15 MΩ•cm at temperature of 50° to 55° C. is produced. This high grade purified water is continuously supplied into the bottom of the fourth tank 11*d*. The low grade purified water is also supplied continuously into the spray devices 15*a*, 15*b*, 15*c* of the first to third tanks. The low grade purified water supplied into the third tank 11*c* overflows when the tank is filled up and runs into the second tank 11*b*, similarly flowing from the second tank 11*b* into the first tank 11*a*. When the first tank 11*a* is filled up, the overflowing water is discharged as washing waste water. The high grade purified water supplied into the fourth tank 11*d* overflows when the tank is filled up, and the overflow water is similarly discharged as washing waste water.

When washing is started, and the washing basket containing works to be degreased and cleaned such as VTR heads is conveyed to a specified position above the first tank 11*a*, compressed air is supplied from the compressor 4 into the bubbling device 12 disposed in the bottom in the first tank 11*a*, and multiple fine bubbles are generated to spread in the entire first tank 11*a*, foaming up on the water surface. Accordingly, the washing basket begins to descend, and sinks into the cleaning fluid in the first tank 11*a*. During immersion, the washing basket is oscillated up and down within a range not coming up above the water level, and is pulled out of this tank after a specified time, and supply of compressed air into the bubbling device 12 stops. In succession, injection of shower water from the spray device 15*a* above the first tank 11*a* begins, and the work is showered together with the washing basket. After injecting shower water for specified time, the shower is stopped, and the washing basket is moved above the second tank 11*b*.

When the washing basket 11*b* comes to specified position above the second tank 11*b*, the ultrasonic wave generating device 13*a* provided outside the bottom in the second tank 11*b* is put in operation, and ultrasonic vibration waves spread over the entire second tank 11*b*. Accordingly, the washing basket begins to descend and sinks into the washing fluid in the second tank 11*b*. During immersion, the washing basket is oscillated vertically in a range not to come above the water level, and is pulled up from this tank after a specified time, and the ultrasonic wave generating device 13*a* stops. In succession, injection of shower water from the spray device 15*b* above the second tank 11*b* is started, and the work is showered together with the washing basket. After injecting shower water for specified time, the shower stops, and the washing basket is moved into the third tank 11*c*.

When the washing basket comes to a specified position above the third tank 11*c*, the ultrasonic wave generating device 13*b* provided outside the bottom in the third tank 11*c* is put in operation, and ultrasonic vibration waves spread over the entire third tank 11*c*. Accordingly, the washing basket begins to descend and sinks into the washing fluid in the third tank 11*c*. During immersion, the washing basket is oscillated vertically in a range not to come above the water level. After a specified time, the water jet generating device 14*a* provided in the bottom in the third tank 11*c* is put in operation, and the injection water flow by the water jet spreads simultaneously with the vibration waves due to ultrasonic waves in the entire third tank 11*c*. In this period, too, oscillation of the washing basket continues, and it is pulled out of this tank after a specified time, and the ultrasonic wave generating device 13*b* and water jet generating device 14*a* stop. In succession, injection of shower water from the spray device 15*c* above the third tank 11*c* is started, and the work is showered together with the washing basket. After injecting shower water for specified time, the shower stops, and the washing basket is moved into the fourth tank 11*d*.

When the washing basket comes to a specified position above the fourth tank 11*d*, the water jet generating device 14*b* provided in the bottom in the fourth tank 11*d* is put in operation, and injection water flow spreads over the entire fourth tank 11*d* by the water jet. Accordingly, the washing basket begins to descend, and sinks into the fourth tank 11*d*. During immersion, the washing basket is oscillated vertically in a range not coming above the water level, and is pulled out of this tank after a specified time, and the water jet generating device stops.

The washing basket containing the works is pulled out of the fourth tank 11*d*, and drained and dried by the dryer 16, thereby finishing the cleaning. As the method of draining and drying, air blow and hot air drying are general, but vacuum drying and other methods may be employed, too.

Example 2

Figure 2:
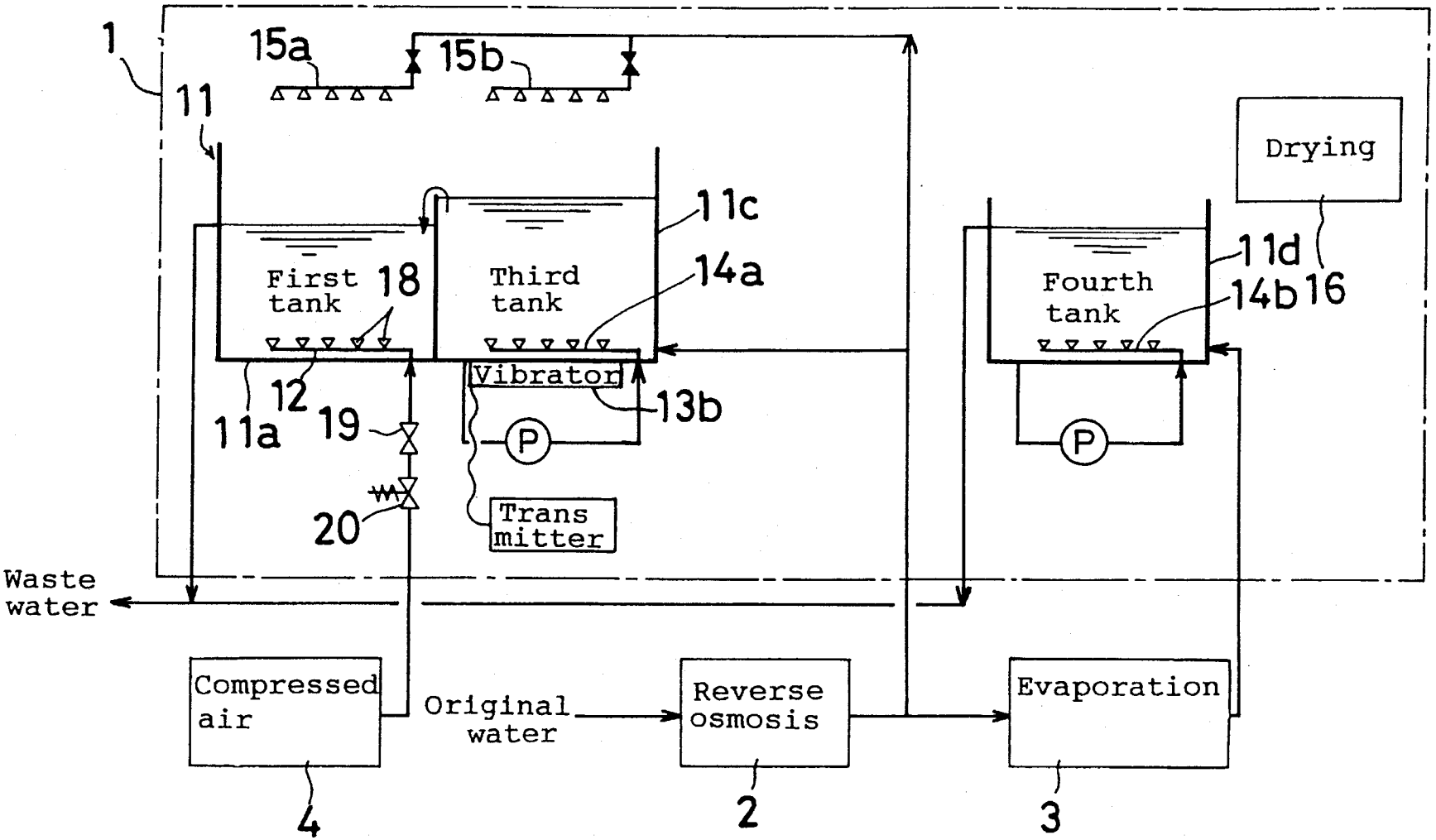
FIG. 2 is a flow sheet showing a cleaning method in embodiment 2.

In this example, as shown in FIG. 2, omitting the second tank in example 1 in FIG. 1, the cleaning tank 11 consists of three tanks. The other constitution is same as in example 1.

When the initial deposit oil amount on the work surface is small, the majority of the oil can be removed by the first tank 11*a* alone. In order to prevent erosion due to cavitation by the ultrasonic wave of the work conveyed from the first tank 11*a* to the third tank 11*c* by skipping the second tank, water jet is used together with ultrasonic vibration in the third tank 11*c*.

Example 3

Figure 3:
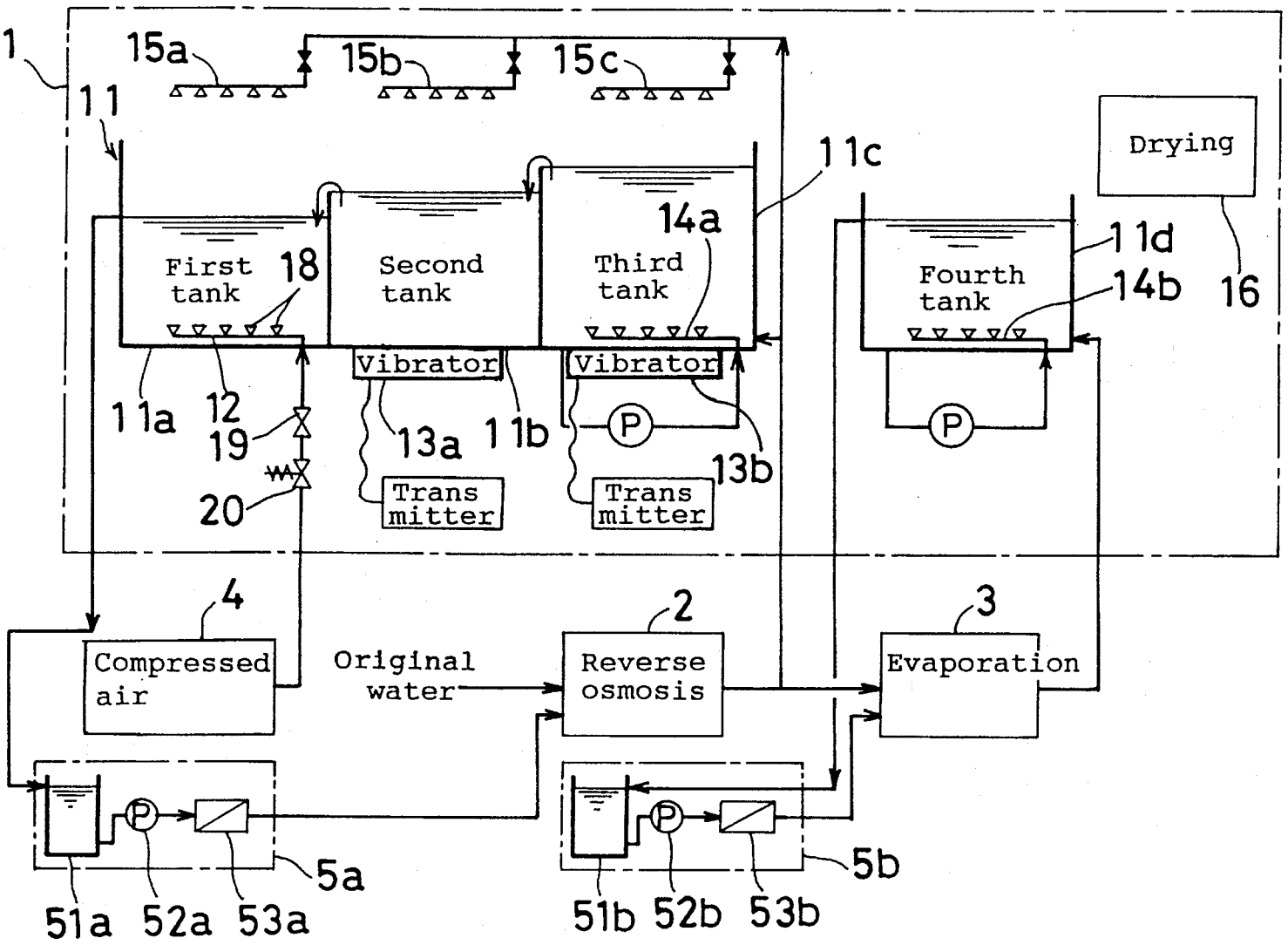
FIG. 3 is a flow sheet showing a cleaning method in embodiment 3.

In this example, as shown in FIG. 3, the washing waste water discharged from the first tank and fourth tank in the example in FIG. 1 is treated in the first and second ultrafiltration waste water treating systems 5*a*, 5*b* to be separated into oil and water, and the filtered water from the first ultrafiltration waste water treating system 5*a* is sent into the reverse osmotic film device 2 and the filtered water from the second ultrafiltration waste water device 5*b* is sent into the evaporation method high temperature purified water manufacturing device 3, to be recycled as original water, respectively. In FIG. 3, reference numerals 51*a*, 51*b* are waste water tanks, 52*a*, 52*b* are waste water pumps, and 53*a*, 53*b* are ultrafiltration film devices. The other constitution is same as in example 1.

Example 4

Figure 4:
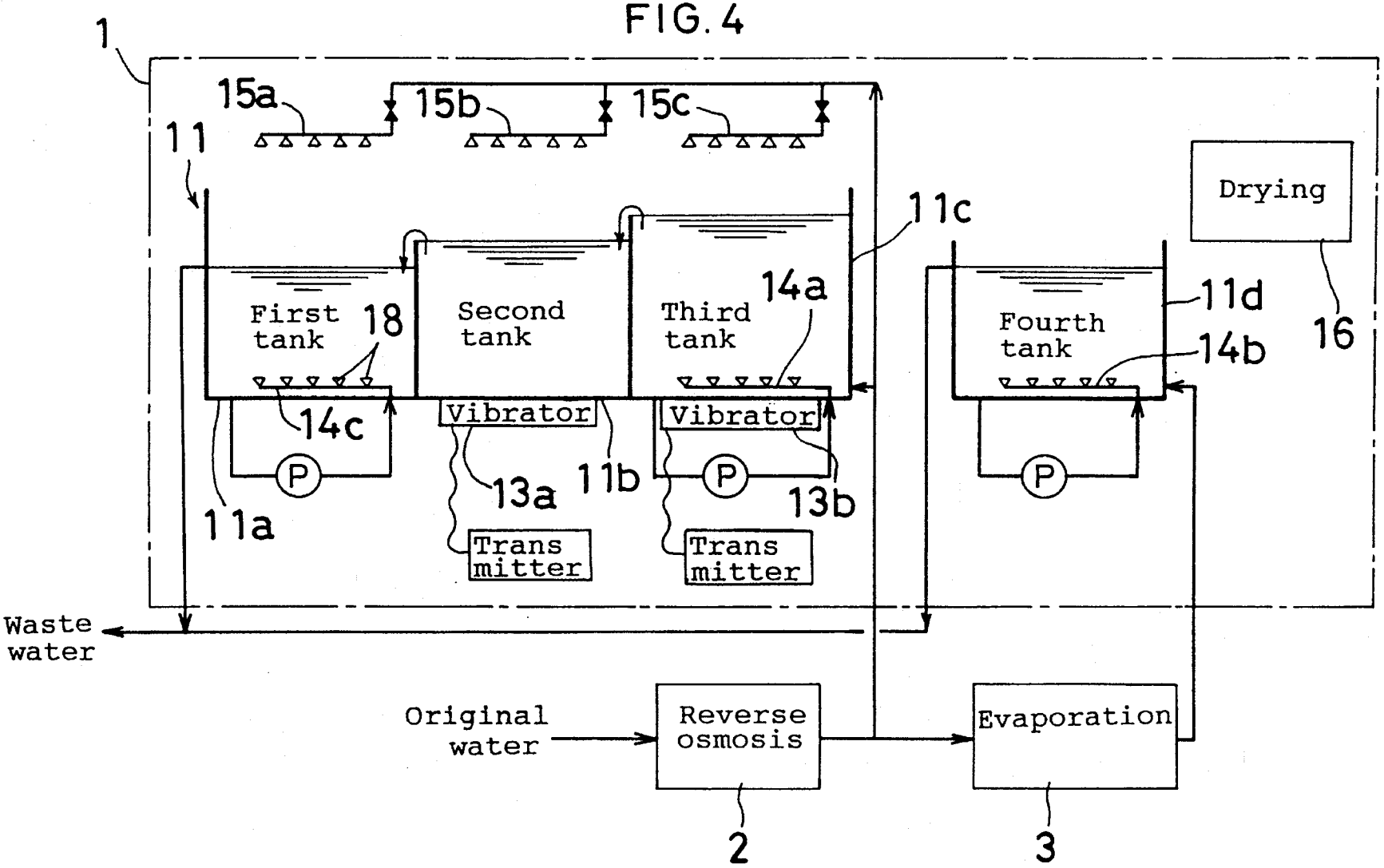
FIG. 4 is a flow sheet showing a cleaning method in embodiment 4.

In this example, as shown in FIG. 4, the bubbling device 12 of the first tank in the example in FIG. 1 is replaced by the water jet generating device 14*c*. The other constitution is same as in example 1.

Example 5

Figure 5:
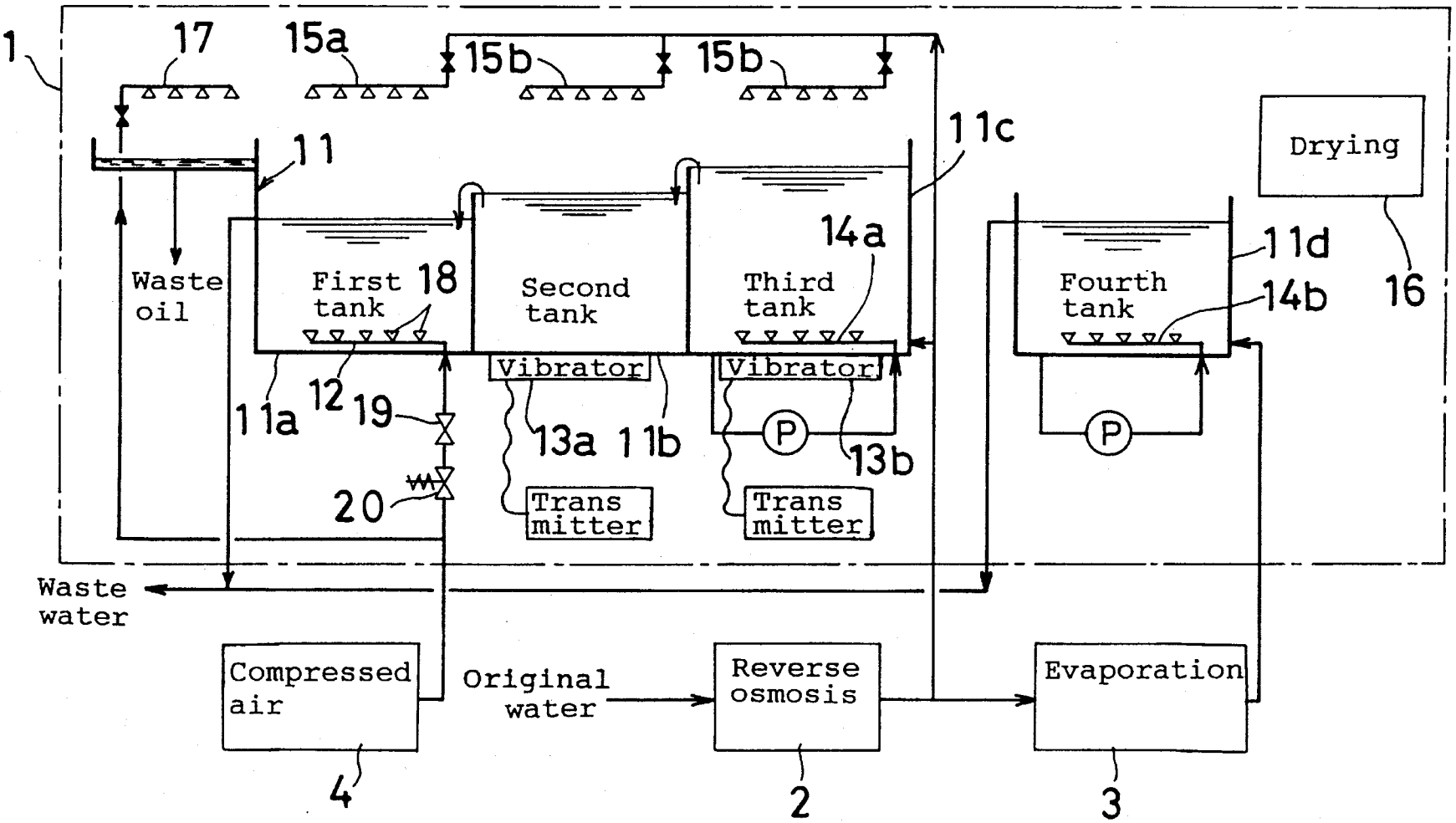
FIG. 5 is a flow sheet showing a cleaning method in embodiment 5.

In this example, as shown in FIG. 5, before immersing the washing basket containing works in the purified water of the first tank in the example in FIG. 1, compressed air is injected to the work by plural air nozzles 17 to blow away the oil, grease and cutting chips depositing on the work surface, thereby decreasing the contamination brought into the first tank. This method is suited when the initial deposit oil amount on the work surface is particularly heavy. The other constitution is same as in example 1.

Example 6

Figure 6:
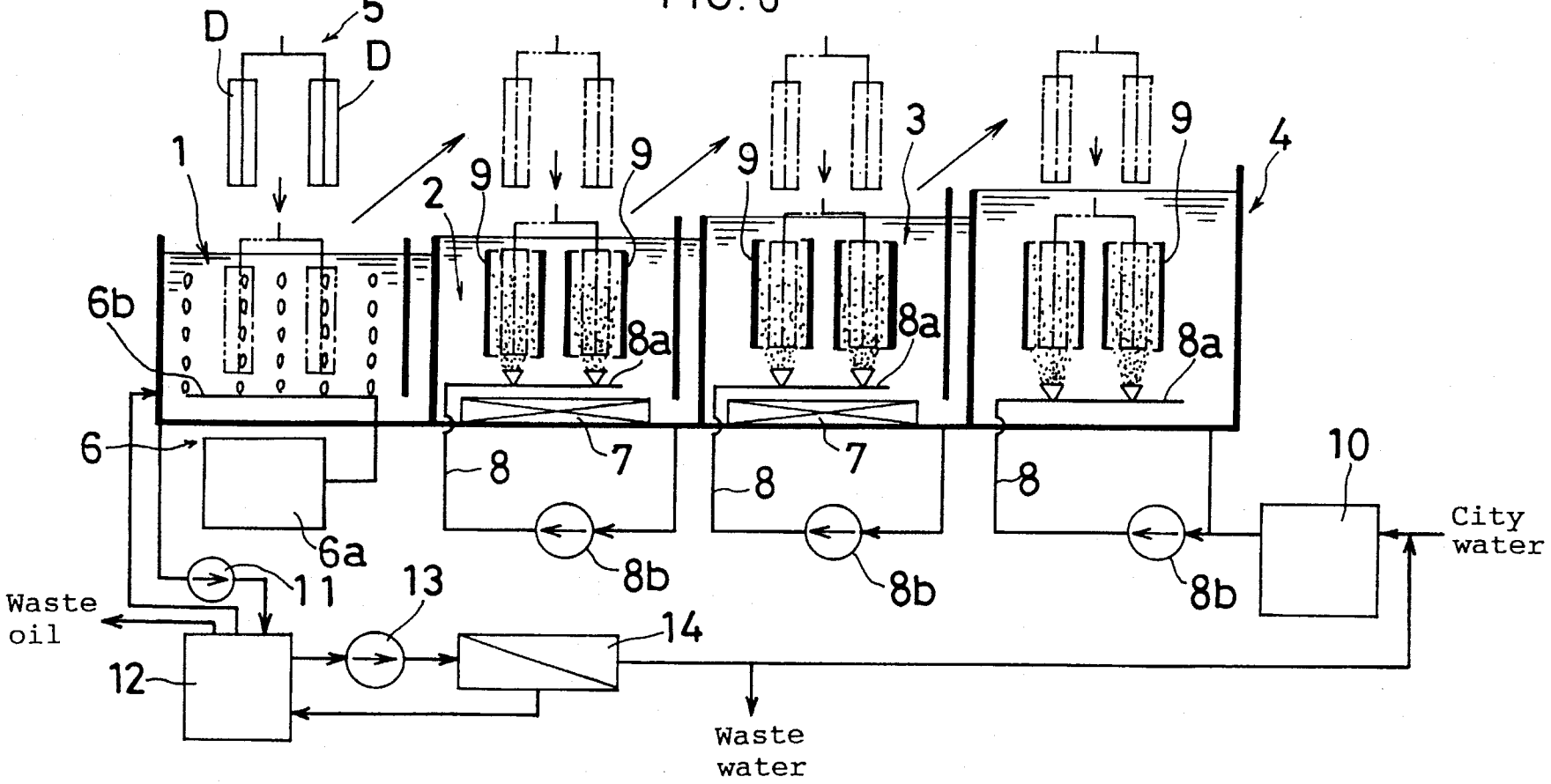
FIG. 6 is a flow sheet showing an embodiment of degreasing cleaning apparatus of the invention.

An example of the second cleaning apparatus is described while referring to FIG. 6. The object to be degreased and cleaned is a photosensitive drum.

The washing water is purified water at 50° to 100° C. obtained from an evaporation method purified water manufacturing device 10. It is also preferred to use purified water obtained with ion exchange method purified water manufacturing device heated to 50° to 100° C. by a heater (steam or electric heater as heat source).

The purified water at specified temperature is supplied into a fourth tank 4, and overflows into a first tank 1 through a third tank 3 and a second tank 2. A drum D is conveyed from the first tank to the fourth tank by a conveying device 5, and immersed in the purified water of each tank successively.

The degreasing cleaning apparatus comprises the first tank 1, second tank 2, third tank 3, and fourth tank 4, a bubbling device 6 is disposed in the bottom of the first tank 1, an ultrasonic wave generating device 7 and a water jet generating device 8 are disposed in each bottom of the second tank 2 and third tank 3, a water jet generating device 8 is disposed in the bottom of the fourth tank 4, and two partition tubes 9 for guide of water flow are vertically disposed in each of the second, third and fourth tanks.

The bubbling device 6 in the first tank 1 is composed of a compressed air feed tube 6*b* possessing plural bubble nozzles for injecting bubbles, and a compressor 6*a* for feeding compressed air into the feed tube.

In the second tank 2 and third tank 3, each ultrasonic wave generating device 7 is set at 26 to 45 kHz. Each ultrasonic wave generating device 7 may be disposed on the side of the tank. Each water jet generating device 8 possesses a pressure water feed tube 8*a* possessing plural jet nozzles for injecting water, and a circulation pump 8*b* for sucking the water in the tank and feeding into the jet nozzles at a pressure of 2 to 10 $kG/cm^2$. The water jet generating device 8 in the fourth tank 4 is composed same as above.

Below the first tank 1, a circulation pump for discharge 11 is disposed, and reference numeral 12 denotes a mist separator, 13 is an ultrafiltration pump, and 14 is an ultrafiltration device.

In the degreasing cleaning apparatus of the example, supposing the cleaning cycle time of each time to be 60 seconds, the cleaning process is described below.

In the first tank 1, fine bubbles leaving the bubble nozzles 6*b* in the bottom agitate the cleaning fluid violently, and by this violent agitation and mutual action of vapor phase and liquid phase, the oil, grease and cutting chips depositing on the drum D are washed away. In this period, the drum D is moved up and down by the conveying device 5. In the first tank 1, as mentioned above, by the washing fluid preheated to a specified temperature, the oil and grease depositing on the drum D are heated, and their viscosity is lowered. That is, the first tank 1 also functions to preheat the oily and greasy deposit for cleaning in the subsequent second tank 2.

In the second tank 2, the oily and greasy deposit on the drum D left over after cleaning in the first tank 1 is washed away, and, at this time, the preheated oil, grease and cutting chip are easily washed and removed by the ultrasonic cavitation and water jet. In the first 50 seconds, only the ultrasonic wave generating device 7 is operated, and in the remaining 10 seconds, the ultrasonic wave generating device 7 and water jet generating device 8 cooperate.

In the third tank 3, the oil and grease left over after cleaning in the second tank 2 are cleaned by the same treating operation as in the second tank 2. By the operation of the third tank 3, the oil, grease and cutting chips depositing on the drum D are cleaned almost completely.

In the fourth tank 4, the drum 4 being rid of oil and grease is rinsed by the water jet generating device 8.

The drum D lifted from the fourth tank 4 by the conveying device 5 is dried for 180 seconds at about 80° C. by a hot air drying device (not shown).

A cleaning test carried out using the apparatus of example 6 is described below.

The drum D is made of aluminum drawn pipe and cut pipe coated with cutting oil (kinematic viscosity 9.6 cSt at 40° C., flash point PM 132° C.). The cleaning result is shown in Table 1. Room temperature standing means cleaning after standing still in suspended state for 1 hour at room temperature after application of cutting oil. The oil coating weight was determined by weighing before and after application. The residual oil deposit was measured by non-dispersion ultrasonic absorption method by extraction of CFC-316 (chlorofluorocarbon) (analysis precision: +/−1.1 $mg/m^2$) .

TABLE 1

| Object | Oil coating weight ($mg/m^2$) | Residual oily deposit ($mg/m^2$) | Remarks |
|---|---|---|---|
| Drawn pipe | 5220 | 1.9 | Room temperature standing |
| Cut pipe | 6351 | 0.0 | Room temperature standing |

It is known from Table 1, that oil and grease are removed very well by cleaning treatment by the degreasing cleaning apparatus of the example.

In this example, the partition tube 9 for guide of water flow was disposed in the second tank 2, third tank 3 and fourth tank 4, but it may be also disposed in the first tank 1. It helps to accelerate the flow velocity of the jet in the tank. As a result, cleaning or rinsing is promoted.

We claim:

1. A cleaning apparatus comprising:

a first tank having a bubbling device disposed in the bottom, and a spray nozzle located above, a second tank having an ultrasonic wave generating device disposed in the bottom or on the side, and a spray nozzle located above, a third tank having an ultrasonic wave generating device disposed in the bottom or on the side, a water jet generating device in the bottom, and a spray nozzle located above, and a fourth tank having a water jet generating device disposed in the bottom.

2. A cleaning apparatus of claim 1, further comprising a reverse osmotic film apparatus for producing low grade purified water used as washing water supplied in the first tank, second tank and third tank, and also as shower water in the first tank, second tank, and third tank, and an evaporation method high temperature purified water manufacturing apparatus for producing high grade purified water to be supplied in the fourth tank.

* * * * *